US009227703B2

(12) United States Patent
Vandenworm

(10) Patent No.: US 9,227,703 B2
(45) Date of Patent: Jan. 5, 2016

(54) BUOYANT STRUCTURE FOR PETROLEUM DRILLING, PRODUCTION, STORAGE AND OFFLOADING

(71) Applicant: SSP TECHNOLOGIES, LLC, Grand Cayman (KY)

(72) Inventor: Nicolaas J. Vandenworm, Houston, TX (US)

(73) Assignee: JURONG SHIPYARD PTE LTD., Singapore (SG)

( * ) Notice: Subject to any disclaimer, the term of this patent is extended or adjusted under 35 U.S.C. 154(b) by 0 days.

(21) Appl. No.: 14/452,826

(22) Filed: Aug. 6, 2014

(65) Prior Publication Data

US 2015/0064996 A1 Mar. 5, 2015

Related U.S. Application Data

(60) Provisional application No. 61/872,515, filed on Aug. 30, 2013.

(51) Int. Cl.

| | |
|---|---|
| ***B63B 35/44*** | (2006.01) |
| ***B63B 3/14*** | (2006.01) |
| ***B63B 1/04*** | (2006.01) |
| ***B63B 3/38*** | (2006.01) |
| ***B63B 11/04*** | (2006.01) |
| ***B63B 39/03*** | (2006.01) |
| ***B63B 39/08*** | (2006.01) |
| *B63H 5/07* | (2006.01) |
| *B63B 3/48* | (2006.01) |

(52) U.S. Cl.

CPC ..... *B63B 35/4413* (2013.01); *B63B 1/041* (2013.01); *B63B 3/14* (2013.01); *B63B 3/38* (2013.01); *B63B 11/04* (2013.01); *B63B 39/03* (2013.01); *B63B 39/08* (2013.01); *B63B 3/48* (2013.01); *B63B 2003/145* (2013.01); *B63B 2003/147* (2013.01); *B63B 2003/385* (2013.01); *B63H 5/07* (2013.01)

(58) Field of Classification Search

CPC ..... B63B 35/44; B63B 35/4413; B63B 35/08
USPC ..... 114/49, 121, 264, 265
See application file for complete search history.

(56) References Cited

U.S. PATENT DOCUMENTS

| | | | | |
|---|---|---|---|---|
| 4,471,708 | A | 9/1984 | Wilson et al. | |
| 8,869,727 | B1 * | 10/2014 | Vandenworm | E02B 3/064 114/259 |
| 2009/0126616 | A1 * | 5/2009 | Srinivasan | B63B 35/44 114/264 |
| 2009/0297276 | A1 | 12/2009 | Foo et al. | |
| 2012/0291685 | A1 | 11/2012 | Vanderworm | |
| 2012/0298027 | A1 | 11/2012 | Srinivasan | |

* cited by examiner

*Primary Examiner* — Lars A Olson
(74) *Attorney, Agent, or Firm* — Buskop Law Group, PC; Wendy Buskop

(57) ABSTRACT

A buoyant structure having a hull, a planar keel defining a lower hull diameter, a lower cylindrical portion connected to the planar keel, a lower frustoconical portion disposed above the lower cylindrical portion with inwardly sloping wall at a first angle, an upper frustoconical portion directly connected to the lower frustoconical portion, and the upper frustoconical portion with outwardly sloping wall, the inwardly sloping wall abutting the outwardly sloping wall forming a hull neck with a hull neck diameter. The buoyant structure having a main deck, a moon pool, and propellers attached to the planar keel, which are operated by a motor or a generator. The buoyant structure connects over a chambered buoyant storage ring.

27 Claims, 10 Drawing Sheets

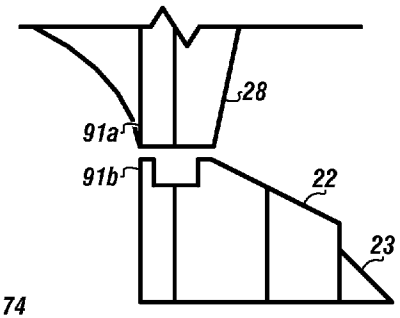
FIGURE 6
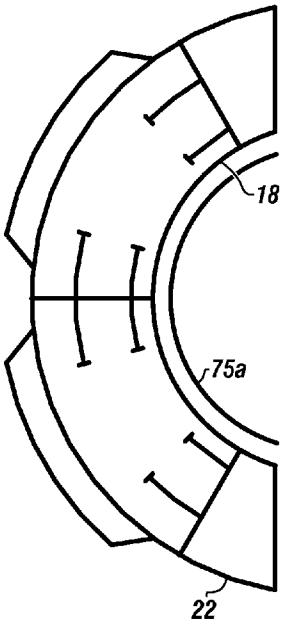
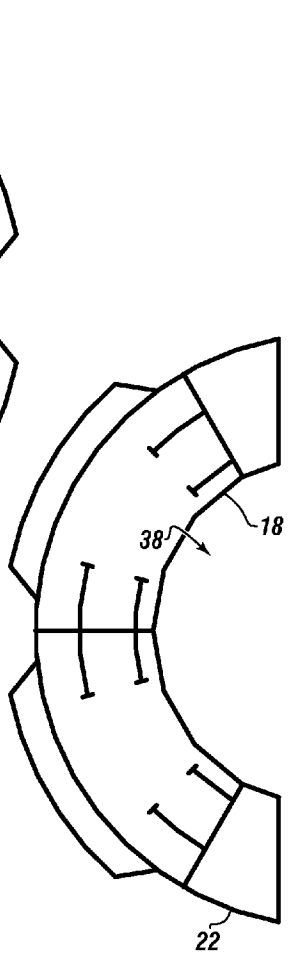
FIGURE 5B
FIGURE 5A

BUOYANT STRUCTURE FOR PETROLEUM DRILLING, PRODUCTION, STORAGE AND OFFLOADING

CROSS REFERENCE TO RELATED APPLICATION

The current application claims priority to and the benefit of co-pending U.S. Provisional Patent Application Ser. No. 61/872,515 filed on Aug. 30, 2013, entitled "BUOYANT STRUCTURE FOR PETROLEUM DRILLING, PRODUCTION, STORAGE AND OFFLOADING". This reference is incorporated in its entirety.

FIELD

The present embodiments generally relate to a buoyant structure for petroleum drilling, production, storage and offloading.

BACKGROUND

A need exists for a highly stable buoyant structure that is a floating vessel that can be towed from drilling location to drilling location at sea or moves on its own power, and which additionally provides storage for tubulars in chambers, preventing tubulars from rolling off into the sea.

A need exists for a drilling vessel that does not easily list.

A further need exists for larger moon pool in a drilling vessel to provide safer drilling operations for handling of equipment and personnel and to provide a larger contained space for making up tubulars and performing topsides subsea drilling activity.

The present embodiments meet these needs.

BRIEF DESCRIPTION OF THE DRAWINGS

The detailed description will be better understood in conjunction with the accompanying drawings as follows:

FIG. 5A depicts a plan view of the lower cylindrical portion of the buoyant structure.

FIG. 5B depicts another plan view of the lower cylindrical portion.

FIG. 6 depicts a detailed view of a plurality of displacement reduction devices.

Figure 1:
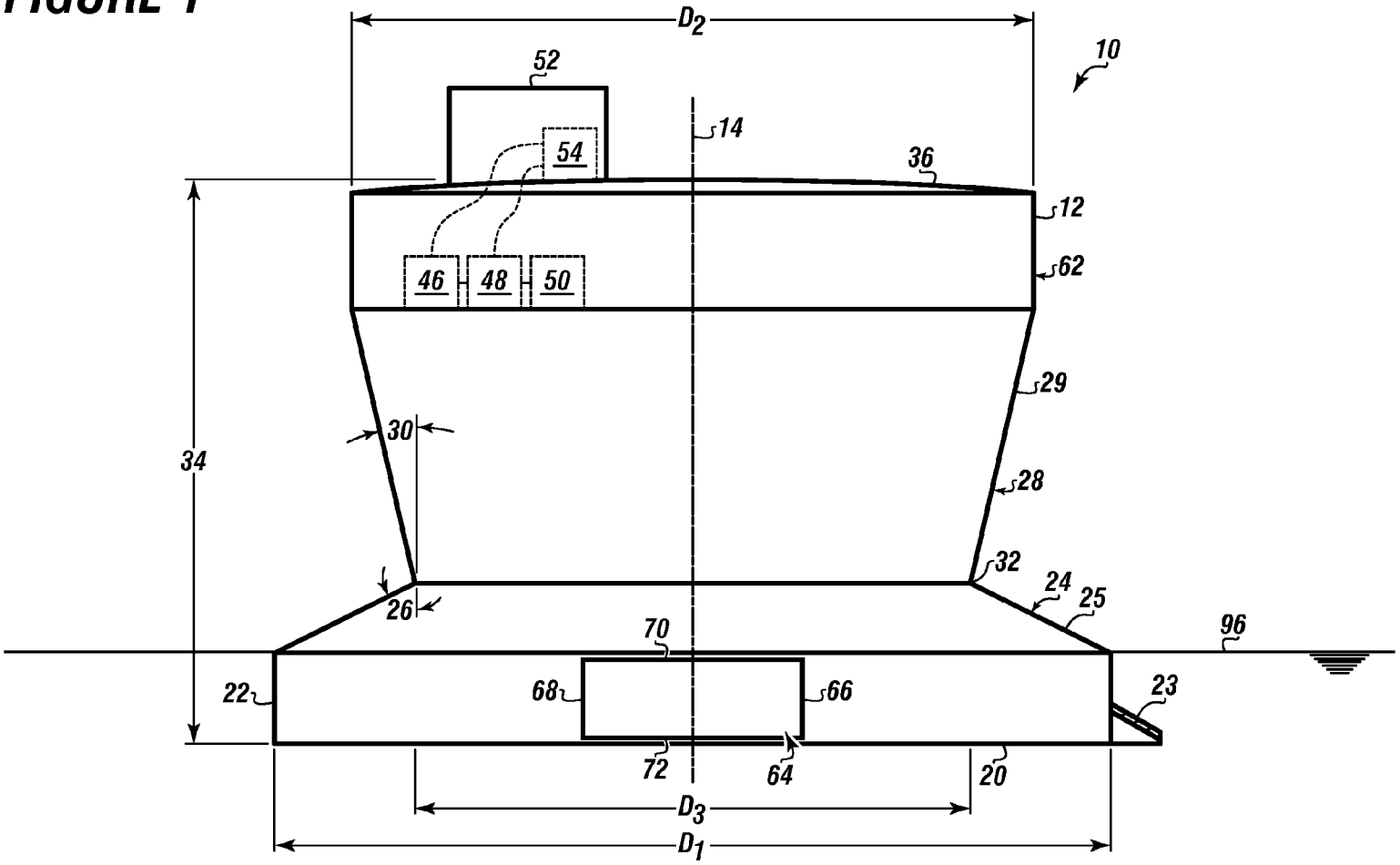
FIG. 1 depicts the buoyant structure in a deballasted state.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a buoyant structure for petroleum drilling, production, storage and offloading, that has a hull that is of a unique shape defining a vertical axis which can be ballasted and deballasted for drilling operation and non-drilling operation modes, respectively.

The hull is characterized by circular horizontal cross-sections at all elevations.

The hull can be defined from the portion that would be closest to the sea floor. This first portion is a planar keel defining a lower hull diameter shown as $D_1$ in the Figures.

The hull can have a lower cylindrical portion connected to the planar keel. The lower cylindrical portion diameter $D_1$ can be the largest diameter of the hull.

The hull can further have a lower frustoconical portion disposed above the lower cylindrical portion.

The lower frustoconical portion can have inwardly sloping walls at a first angle. These inwardly sloping walls slope away from the circumference of the lower cylindrical portion towards the vertical axis.

The term "inwardly sloping" as used herein can refer to a slope that is away from the perimeter or circumference and towards the vertical axis. The inwardly sloping walls slope at angles generally from 50 degrees to 70 degrees as measured against the vertical axis.

The hull can have an upper frustoconical portion directly connected to the lower frustoconical portion.

The upper frustoconical portion can have outwardly sloping walls and the lower frustoconical portion can have an inwardly sloping wall sloping at a second angle relative to the vertical axis.

The outwardly sloping wall can be at a second angle with respect to the vertical axis from 3 degrees to 45 degrees.

The outwardly sloping wall abuts the inwardly sloping wall forming a hull neck with a hull neck diameter $D_3$.

The hull can have a hull height which is defined from the planar keel to a main deck. The hull height defined from the planar keel to the main deck is from 45 percent to 90 percent of the hull neck diameter $D_3$.

The hull height can range from 30 meters to 80 meters.

The hull neck diameter $D_3$ can be the smallest diameter $D_3$ of the hull. The hull neck diameter $D_3$ can be from 75 percent to 90 percent of the upper hull diameter $D_2$.

In embodiments, the main deck can be a generally horizontal main deck that additionally defines an upper hull diameter $D_2$.

The main deck can be connected over the upper frustoconical portion and can have a navigation tower, heliport, receiving deck space for cargo, mooring tie downs, shark jaws used for towing, and space for additional equipment not limited to a derrick, accumulator, hoist, generators, top drives for the derrick, and devices for picking up and making up tubulars.

The hull can have a lower cylindrical portion diameter $D_1$ that is from 115 percent to 130 percent of the upper hull diameter $D_2$.

Within the hull, below the main deck and above the planar keel can be a moon pool.

In embodiments, a plurality of watertight compartments can be positioned between the outer hull side and the moon pool.

The moon pool can have a moon pool diameter that can be tapered and generally increasing inside toward the planar keel.

The moon pool can have a first or initial moon pool diameter proximate the main deck which can be small and then that diameter can gradually increase as the moon pool diameter approaches the planar keel.

In embodiments, the moon pool is in the shape of a half ellipse with a minor radius of the ellipse being from 10 percent to 30 percent of the diameter of the upper hull diameter and a major radius of the ellipse being from 25 percent to 50 percent of the upper hull diameter.

In embodiments, the hull can contain a first tunnel that is an opening in the wall of the lower cylindrical portion and extends through to the moon pool.

The first tunnel can have a first tunnel side wall, a second tunnel side wall and a tunnel top connecting the tunnel side walls.

The tunnel serves to reduce friction of water during transport or transit of the buoyant structure.

A plurality of heave control terraces can be formed in a wall portion that surrounds the moon pool in the hull and adjacent the water of the moon pool. The plurality of heave control terraces can be in the wall portions around the moon pool and proximate to the planar keel adjacent the water in the moon pool.

The plurality of heave control terraces can extend away from the wall portion for controlling heave in the moon pool by reducing up and downward thrust of the water in the moon pool area.

Propellers can be attached to the planar keel and operated by a motor, such as a diesel motor, with a diesel electric generator, wherein the motor and generator can connect to a fuel tank. In embodiments the fuel tank can hold 75,000 barrels of diesel.

The propellers, motor, and generator area can communicate with a control center, such as in the pilot house, having a navigation system, such as a global positioning system (GPS), a dynamic positioning system (DPS) or other navigation system. The control center can use the navigation system to dynamically position the buoyant structure over a well for drilling or for propulsion for transit, such as to another location.

A plurality of ballast tanks, which can have pumps, can be connected to the control center for ballasting and deballasting the hull on demand. The ballast tanks may incorporate material of various densities to affect pitch and roll.

The buoyant structure provides high reserve buoyancy due to a continuation of a symmetrical water line.

The buoyant structure has a hull that protects personnel and equipment and drilling fluids from unexpected instability by the use of controlled water ballast systems within the hull compartments.

The moon pool of the buoyant structure provides increased safe work environment for drilling personnel in all weather conditions by enable workers to work on many levels of a moon pool without being exposed to arctic winds, or harsh rain, or gale force storms.

The buoyant structure provides a stable power consumption regime as a floating drilling platform, as the hull is not required to weathervane. This buoyant structure allows the hull to use dynamic positioning and therefore be less sensitive to drastic environmental changes in directions, such as when hurricane force 1 winds are coming from the southwest then magically swing around to be coming from the northwest, this hull, using dynamic positioning, can more easily handle these wind changes compared to a moored vessel.

In embodiments, the buoyant structure can be moored.

The design of the hull of the buoyant structure provides a high freeboard therefore reduces the likelihood of personnel being exposed to green water.

The buoyant structure provides a reduction in sensitive structural areas being exposed to wave slamming forces impacts during operational conditions.

The buoyant structure can be ballasted and deballasted using a plurality of ballast compartments with connected water pumps to partially fill with ballast sea water to stabilize the hull, providing increased safety for personnel and equipment against any collisions by rogue floating objects. When compared to semisubmersibles, the buoyant hull reduces the permeability of spontaneous flooding in void spaces.

In embodiments, the buoyant structure can have an outer hull side and an inner hull side which can be separated by watertight compartments.

In embodiments, the buoyant structure can have an upper cylindrical portion connected between the deck and the upper frustoconical portion.

In embodiments, the buoyant structure can have a first tunnel and a second tunnel extending through the lower cylindrical portion to the moon pool.

The second tunnel can be connected to the first tunnel at an angle from 180 degrees to 270 degrees in a first direction and at an angle from 180 degrees to 90 degrees in a second direction from the first tunnel.

The second tunnel can have a pair of second tunnel sides walls connected with a second tunnel top.

In embodiments, the buoyant structure can have a plurality of tunnels extending through the lower cylindrical portion. In other embodiments, the tunnels can form a peace sign of a first tunnel connected to a second and third tunnel at an angle.

In embodiments, the buoyant structure can have the first and second tunnels fluidly connected through the moon pool at a 180 degree angle.

The tunnels can each have bottoms that extend the length of the tunnel. The reason for the bottoms for the tunnels is to reduce the buildup of hydrostatic resistance during transit speeds through the water column and the reduction of trapped water within the moon pool to reduce displacement.

In embodiments, the moon pool can be centrally disposed around the vertical axis. The moon pool can also be positioned off center of the vertical axis, such as in a side of the hull.

The term "bell shaped" as used herein means an elliptical shape that is specifically a half elliptical shape; with the narrow end of the elliptical shape proximate the main deck.

The term "bell shaped" also refers to an elliptical shape transitioning to a cylindrical shape at the portion of the bell shape that is proximate the planar keel.

The term "bell shaped" as used herein also refers to a geodesic curve, which is known to be a series of straight lines connecting nodes positioned on a half elliptical curve creating inward sloping walls.

In metric geometry, a geodesic shape is formed using a curve which is everywhere locally as a distance minimizer. More precisely, a curve $\gamma: I \rightarrow M$ from an interval I of the reals to the metric space M is a geodesic if there is a constant $v \geq 0$ such that for any $t \in I$ there is a neighborhood J of t in I such that for any $t_1, t_2 \in J$ the formula is created $d(\gamma(t_1), \gamma(t_2)) = v|t_1 - t_2|$.

In metric geometry the geodesic considered is often equipped with natural parameterization, that is, in the above identity $v=1$ and $d(\gamma(t_1), \gamma(t_2)) = |t_1 - t_2|$.

If the last equality is satisfied for all $t_1, t_2 \epsilon I$, the geodesic is called a minimizing geodesic or shortest path. Such a geodesic shape with a minimizing path is used in this invention.

In embodiments, the buoyant structure has a first moon pool diameter proximate the main deck that gradually increases towards a sea bottom at a plurality of variable rates. The moon pool can connect with lower decks first then the main deck.

The moon pool diameter can increase at a different rate for different sections of heights from the first moon pool diameter to a second moon pool diameter.

In embodiments, the buoyant structure can have multiple connected heave control terraces. In embodiments, the heave control terraces can be staggered as they are positioned around the wall portion of the moon pool.

In embodiments, the heave control terraces can each have a length from 1 meter to 20 meters, a width from 0.5 meters to 3 meters, and a height from 3 centimeters to 20 centimeters. In other embodiments, the heave control terraces can have different dimensions within the above ranges.

In embodiments, the heave control terraces can each have a plurality of perforations. The term "perforations" as used herein can refer to holes made in the heave control terraces. In embodiments, some heave terraces can have perforations while others do not.

In embodiments, the buoyant structure can have heave control terraces made from either 3 centimeters thick corrugated steel plate creating waves from 1 centimeter to 15 centimeters in height or smooth steel plate.

In embodiments, the buoyant structure can have a first displacement reduction device formed in either the upper frustoconical portion or the lower frustoconical portion. The term "displacement reduction device" can refer to a bucket shaped device having a bucket bottom, a bucket first side, and a bucket second side connected to the bucket bottom.

In embodiments, the buoyant structure can have a second displacement reduction device formed in the frustoconical portion which does not contain the first displacement reduction device.

In embodiments, the buoyant structure can have a plurality of displacement reduction devices formed in the upper frustoconical portion, the lower frustoconical portion or combinations thereof.

In embodiments, the buoyant structure can have a plurality of decks formed in the hull between the main deck and lower frustoconical portion. Each deck can extend from the moon pool to the inner hull side, except for the main deck which can extend to the outer wall. Examples of what is on the decks can include mezzanine deck and cellar deck.

In embodiments, the buoyant structure can have a water tight storage chamber for storing tubulars usable in drilling operations.

The tubulars can be drill pipe, casing, marine risers, and combinations thereof.

In embodiments, the vertical storage chamber can be disposed in parallel to the vertical axis and the vertical storage chamber can be accessible from one or more of the plurality of decks, the moon pool and combinations thereof.

In embodiments, the buoyant structure can have multiple propellers mounted to the planar keel, connected to diesel-electric motors with connected fuel powered generators, and a control center having a navigation system. The propellers with motors and generators can be connected to the navigation system providing propulsion and dynamic positioning. The navigation system can connect to a satellite dynamic positioning system allowing for remote dynamic positioning of the vessel.

In embodiments, the planar keel can be a planar horizontal keel. The keel can be slightly rounded in embodiments, for faster transiting and lower fuel consumption.

In embodiments, the moon pool can have a constant diameter portion wherein the constant diameter is from the keel to up to 16 meters from the keel.

In an embodiment, the buoyant structure can be positioned over and connected to a chambered buoyant storage ring formed from a plurality of interlocking sections or segments.

In embodiments, the chambered buoyant storage ring can be towable and modular with each section being individually ballasted. The chambered buoyant storage ring can create a semi-permanent subsea landing platform for the buoyant structure.

The chambered buoyant storage ring can, in embodiments, safely dock and lock, beneath the buoyant structure allowing drilling through an opening in both the buoyant structure and in the chambered buoyant storage ring thereby creating an environmentally safe, operationally containable environment.

The coupled buoyant structure with interlocking modular chambered buoyant storage ring can be particularly usable for artic, shallow water conditions.

In an embodiment, multiple chambered buoyant storage rings can be connected in series thereby daisy-chaining storage and flow lines together to optimize subsea architecture to support the production for full field development.

Preset flanges and piping can be used on the chambered buoyant storage ring for connecting to the buoyant structure and between sections of the storage ring.

Preset intakes, internal piping, and preset out-takes can be used enabling the towable modular interlocking chambered buoyant storage rings to have quick connect, and inter-connectability, enabling the units to be enlarged as drilling occurs.

One of the benefits of the towable modular interlocking chambered buoyant storage ring is spill containment for a well that erupts.

Preset out-takes can be used enabling the modular interlocking chambered buoyant ring to siphon off (such as transfer) hydrocarbons from the storage ring to an adjacent floating storage vessel by means of a pre-connected flow line attached to one of the preset flanges on the storage ring.

A benefit of the invention is that the buoyant structure can be positioned over a damaged well, allowing hydrocarbons including volatile organic carbons, to be sucked away and transferred to a tanker or barge, for nearby correct environmental containment and storage.

In an embodiment, each towable modular interlocking chambered buoyant storage ring can contain from 4597 cubic meters to 305614 cubic meters of fluid storage, such as hydrocarbon storage.

In an embodiment, the chambered buoyant storage ring can have 3 to 4 bulkheaded storage sections interlocking as jigsaw puzzle pieces.

Dimensionally, the towable modular interlocking chambered buoyant storage rings can have a height from 10 feet to 60 feet, can have a deballasted depth, which is known as transit depth, of 10 feet to 20 feet, and can have a ballasted depth of 20 feet to 40 feet.

The towable modular interlocking chambered buoyant storage ring can be ballasted to float completely underwater. Each bulkheaded storage section can be ballasted to individually float underwater.

Turning now to the Figures, FIG. 1 depicts the buoyant structure in a deballasted state, such as when in transit. FIG.

2 depicts the buoyant structure in a ballasted state, such as an operational condition for drilling a well or working over a well.

Figure 2:
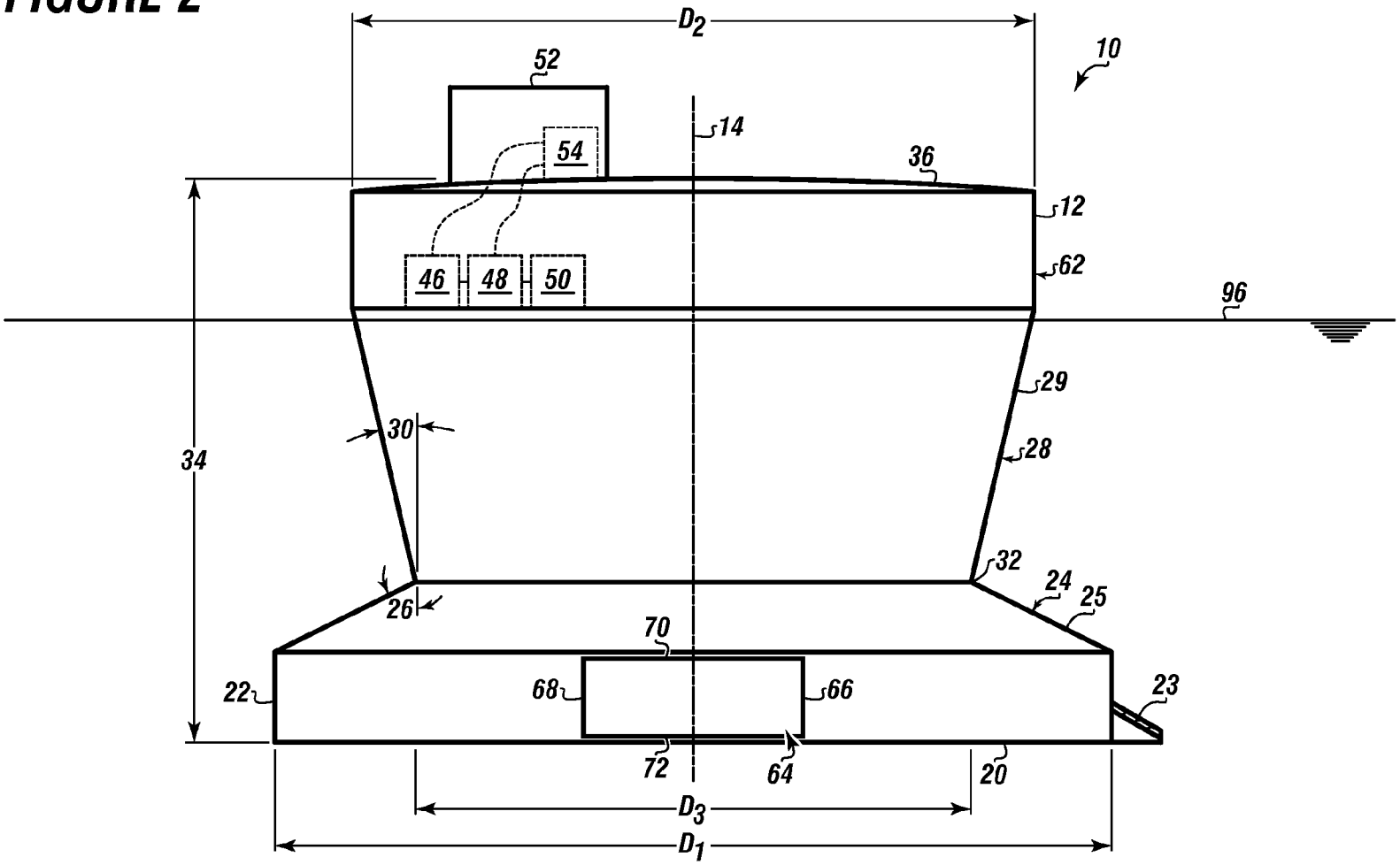
FIG. 2 depicts the buoyant structure in a ballasted state.

Referring to FIGS. 1 and 2, the buoyant structure 10 can include a hull 12 with a vertical axis 14 and an upper hull diameter $D_2$.

The hull 12 can have an outer hull side connected to an inner hull side. The outer hull side can be characterized by an outer hull shape selected from the group: circular, elliptoid, and geodesic shape in horizontal cross-sections at all elevations. The inner hull side can be characterized by a shape selected from the group: circular, elliptoid, and geodesic shape.

In embodiments, the hull 12 can include a planar keel 20 defining a lower hull diameter $D_1$, and a lower cylindrical portion 22 connected to the planar keel 20.

In embodiments, the lower cylindrical portion 22 can have a diameter identical to the lower hull diameter $D_1$, and both diameters can be the largest diameter of the hull. The lower hull diameter $D_1$ can be from 101 percent to 130 percent of the upper hull diameter $D_2$.

In embodiments, a lower frustoconical portion 24 can be disposed above the lower cylindrical portion 22. The lower frustoconical portion 24 can have an inwardly sloping wall 25 that is created at a first angle 26. The first angle 26, with respect to the vertical axis 14, can range from 50 degrees to 70 degrees.

The hull 12 can include an upper frustoconical portion 28, which can be directly connected to the lower frustoconical portion 24. The upper frustoconical portion 28 can have an outwardly sloping wall 29 at a second angle 30. The second angle can be from 3 degrees to 45 degrees from the vertical axis. The second angle can be particularly advantageous for ice breaking conditions in the artic.

The lower frustoconical portion can have an inwardly sloping wall 25 that abuts the outwardly sloping wall 29. The intersection of the two walls can form a hull neck 32 with a hull neck diameter $D_3$. The hull neck diameter can be at least 10 percent less than the lower hull diameter.

The buoyant structure can have a hull height 34 measured from the planar keel 20 to a main deck 36. In embodiments, the main deck 36 can be connected over the upper frustoconical portion 28. In embodiments, the main deck 36 can be round, square or rectangular in shape.

In embodiments, the lower cylindrical portion 22 can have a diameter from 115 percent to 130 percent of the upper hull diameter $D_2$.

In embodiments, the buoyant structure can have a moon pool centrally formed around the vertical axis or offset from the vertical axis.

The buoyant structure 10 can have a first tunnel 64 which can extend through the lower cylindrical portion to the moon pool. The first tunnel can have a first tunnel side wall 66, a second tunnel side wall 68, and a first tunnel top 70 connecting the tunnel side walls. In embodiments, the first tunnel can have a first tunnel bottom 72 that connects the tunnel sides. The first tunnel can be square or rectangular in cross section, and can have another usable geometry that allows egress of boats, material or both from the moon pool.

The water level 96 can be at a height between the planar keel 20 and the lower frustoconical portion 24 when the hull is deballasted and ready for transit, as shown in FIG. 1.

The water level 96 can be at a height between the upper frustoconical portion 28 and the main deck 36 when the buoyant structure is ballasted and ready for drilling operation, as shown in FIG. 2.

An upper cylindrical portion 62 can be between the main deck 36 and the upper frustoconical portion 28. The upper cylindrical portion 62 can be used for storing machines and bulk materials.

The buoyant structure 10 can have a motor 46 connected to a generator 48, connected to a fuel tank 50 positioned below the main deck in the upper cylindrical portion 62. In embodiments, the motor can be a diesel-electric motor. In embodiments, there can be more than one motor. In embodiments, each motor can produce 9000 hp. In embodiments the generator can be a diesel operated generator, such as a generator from Wartsilla or Siemens that can be used with a capacity of 36+ megawatts of power.

The motor 46 and generator 48 can be in communication with a control center 52 mounted above the main deck. The control center 52 can have a navigation system 54 in communication with the motor and generator. In embodiments, the total capacity of the motors can be 38 megawatts. A pilot house can act as the control center 52 which can contain a computer with software to provide a navigation system 54 used for navigation with satellites of a dynamic positioning system or with another network, such as a global positioning system network.

Propellers can be secured to the planar keel and can be operated by the motor. The control center can use the navigation system 54 to dynamically position the ballasted buoyant structure over a well for drilling. In embodiments, the control center can use the navigation system 54 to drive and steer the buoyant structure using the propellers for propulsion during transit when deballasted.

The buoyant structure can be moored to the sea bed or to structures positioned under water.

The control center can control a plurality of ballast tanks connected to the main deck or mounted on the buoyant vessel above the planar keel for ballasting and deballasting the hull. The buoyant structure can define a center of gravity and a center of buoyancy with the center of gravity being below the center of gravity.

The buoyant structure can include a lower keel frustoconical portion 23 extending from the lower cylindrical portion 22 in a direction away from the vertical axis. In embodiments, the lower keel frustoconical portion 23 can extend from 40 percent to 95 percent the vertical height of the lower cylindrical portion and can extend at an angle from 30 degrees to 70 degrees from the vertical axis.

Figure 3:
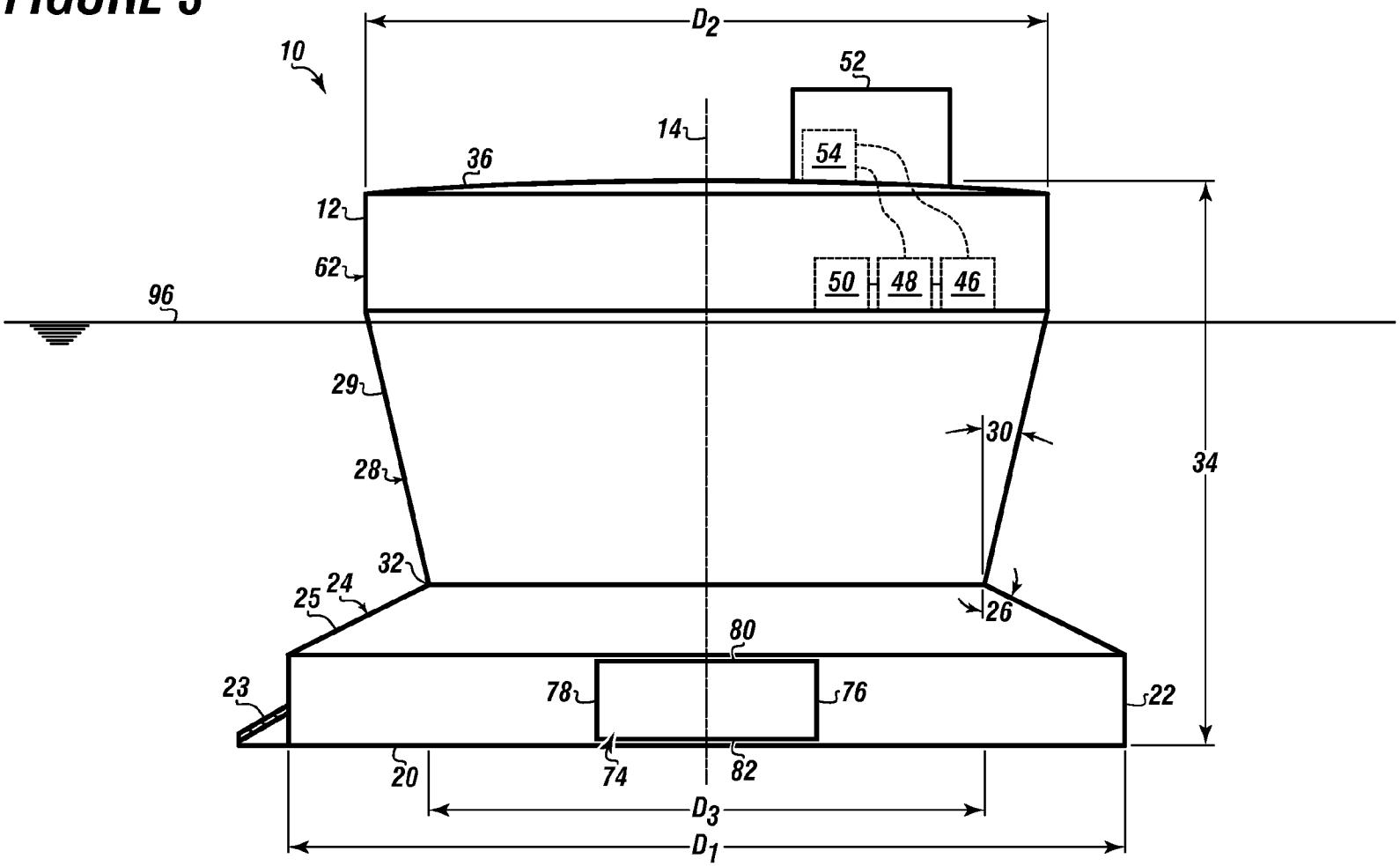
FIG. 3 depicts a back view of a ballasted buoyant structure floating.

FIG. 3 depicts a back view of a ballasted buoyant structure floating.

This FIG. 3 has all the same parts as FIGS. 1 and 2 except a second tunnel is depicted.

The buoyant structure 10 is shown with the hull 12 with a vertical axis 14; planar keel 20 with a lower cylindrical portion 22, lower frustoconical portion 24 and lower keel frustoconical portion 23; inwardly sloping wall 25 of the lower frustoconical portion is at a first angle 26; outwardly sloping wall 29 of the upper frustoconical portion 28 at a second angle 30; hull neck 32; total hull height 34; main deck 36; motor 46; generator 48; fuel tank 50; control center 52 with a navigation system 54; upper cylindrical portion; water level 96; lower hull diameter $D_1$; upper hull diameter $D_2$; and hull neck diameter $D_3$.

The buoyant structure can have a second tunnel 74. The second tunnel can have a first second tunnel side wall 76, a second second tunnel side wall 78 and a second tunnel top 80 that connects between the second tunnel side walls. In embodiments, the second tunnel 74 can have a second tunnel bottom 82 connected between the second tunnel side walls.

In embodiments, the second tunnel can be at an angle from 180 degrees to 270 degrees from the first tunnel. In embodiments, the second tunnel bottom can extend the entire length of the second tunnel. In embodiments, the water can fill the first or second tunnel to any height from dry to the maximum height of the tunnel. In embodiments a plurality of tunnels can be created between the outside walls of the buoyant structure and the moon pool. The tunnels can be used to reduce the resistance of the hull through a water column when the buoyant structure is in transit.

Figure 4:
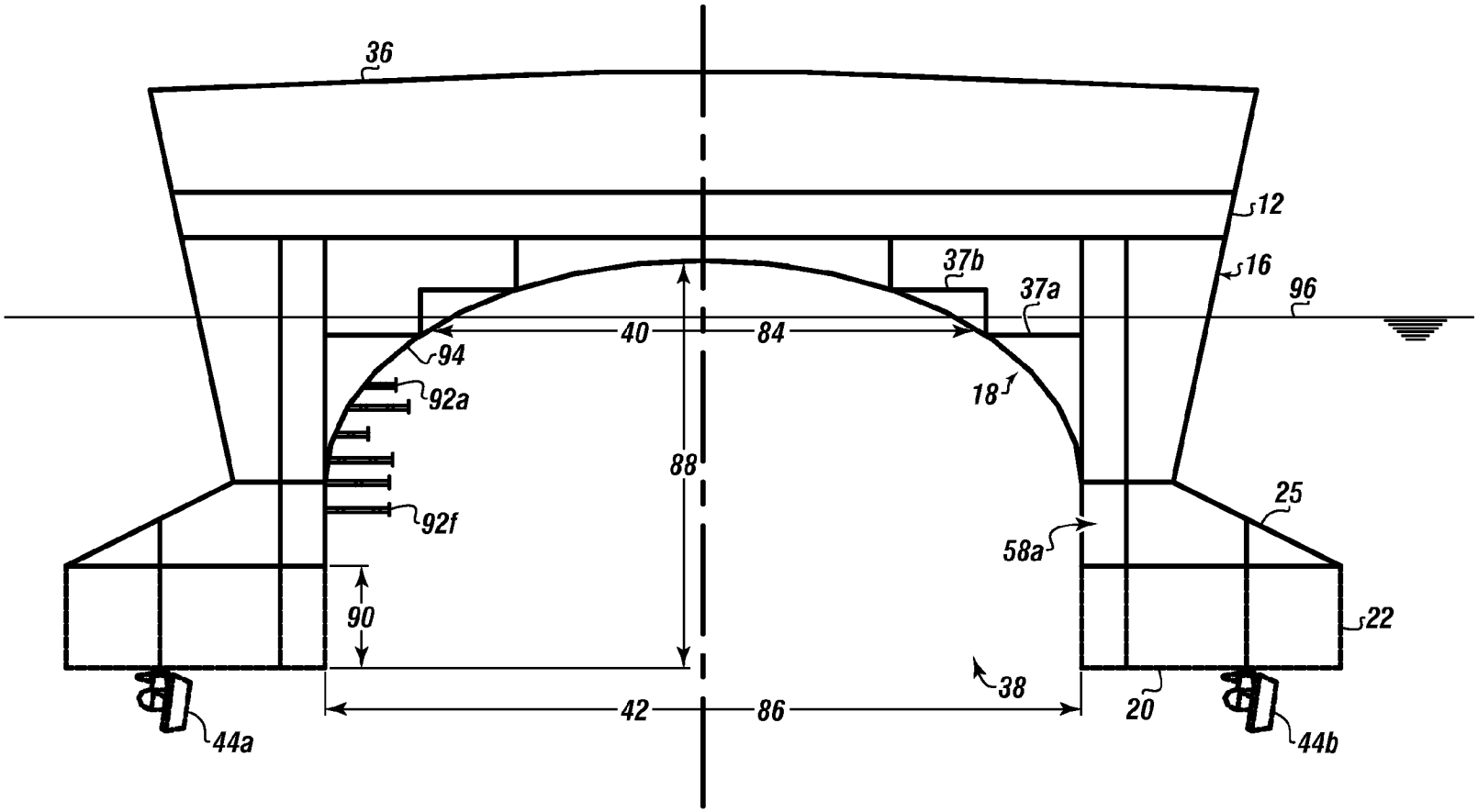
FIG. 4 depicts a cross section of the hull.

FIG. 4 depicts a cross section of the hull.

The buoyant structure is shown ballasted down with 50 percent of the hull 12 below the water level 96 for operations, such as drilling or working over wells.

The hull 12 can have an outer hull side 16 and an inner hull side 18. The hull sides can be formed from steel plates. The planar keel 20 can be made from the same steel as the outer hull side and inner hull side.

Propellers 44*a* and 44*b* can extend from the planar keel. The propellers can be four bladed and can be azimuth thrusters in an embodiment. The propellers can be mounted and dismounted without the need for dry dock.

The lower cylindrical portion 22 can extend above the planar keel and can have a diameter of 112 meters. The lower frustoconical portion can have inwardly sloping wall 25 at an angle of 60 degrees.

The buoyant structure can include lower decks 37*a* and 37*b* that can support bulk storage, such as for drilling muds and cement. In embodiments, the lower decks can be used for handling equipment for blow out preventers or tubulars.

The buoyant structure can include a moon pool 38. The moon pool can be bell shaped. The moon pool can be formed by the inner hull side characterized by a shape selected from the group: circular, elliptoid, and geodesic shape.

The moon pool can have a first moon pool diameter 40 proximate the main deck 36 which can increase to a second moon pool diameter 42 proximate the planar keel. The second moon pool diameter can be smaller than the upper hull diameter.

In embodiments wherein the moon pool has an elliptoid shape, the moon pool can have a moon pool minor radius 84 and a moon pool major radius 86. The moon pool minor radius can be 10 percent to 30 percent the diameter of the main deck, and the moon pool major radius can be 25 percent to 50 percent the diameter of the main deck.

The moon pool can have a moon pool height 88.

The moon pool can have a constant diameter section 90 formed in the lower cylindrical portion 22 extending to the planar keel 20. In embodiments, the constant diameter section 90 can have a diameter of 9 meters. In embodiments, the constant diameter section can extend up to 16 meters from the planar keel.

The buoyant structure can have a plurality of heave control terraces 92*a*-92*f*. Each heave control terrace does not hold water. Each heave control terrace can act as a baffle and generates drag on the water to stop instability of the buoyant structure. In embodiments, the heave control terraces can be staggered or can be identical in length. A minimum of three heave control terraces can be used in an embodiment.

The heave control terraces can be attached to a wall portion 94 of the moon pool. The wall portion can be attached to the lower decks 37*a* and 37*b*.

At least one ballast tank 58*a* can be mounted within the hull in communication with the control center. The ballast tank can be used for ballasting and deballasting the hull.

FIG. 5A depicts a plan view of the lower cylindrical portion of the buoyant structure.

The lower cylindrical portion 22 can have a first tunnel 64 and second tunnel 74 formed therein with the buoyant structure in a ballasted operational condition.

A first hydro transit diverter bulkhead 75*a* can be formed between a side wall of the first tunnel and a side wall of the second tunnel. The first hydro transit diverter bulkhead can be solid and can align and mirror the curve of the inner hull side 18 forming the moon pool 38. The hydro transit diverter bulkhead can mirror a curve that is a circular, elliptoid or geodesic.

A second hydro transit diverter bulkhead 75*b* can be formed between a side wall of a first tunnel and a side wall of a second tunnel and formed in a straight line across the moon pool 38.

In an embodiment, the second hydro transit diverter bulkhead 75*b* can be solid and can cross from one side of the first tunnel to an opposite side of the second tunnel across the moon pool 38.

In the embodiment, the second hydro transit diverter bulkhead can contain ballast tank compartments 79*a* and 79*b* in communication with the control center for use in stabilizing the buoyant structure.

In an embodiment, a hydro transit diverter bulkhead can be formed between a side wall of a first tunnel and simply extend partially into the moon pool from an inner hull side. In embodiments, at least one of the hydro transit diverter bulkheads can be attached to the planar keel.

FIG. 5B depicts another plan view of the lower cylindrical portion 22.

At least a portion of the inner hull side 18 can have a geodesic shape. In embodiments, the moon pool 38 into which the first tunnel 64 and second tunnel 74 connect can be 100 percent geodesic in shape, or 100 percent curved completely surrounding the moon pool.

FIG. 6 depicts a detailed view of a plurality of displacement reduction devices.

A first displacement reduction device 91*a* can be in the upper frustoconical portion 28 of the hull. A second displacement reduction device 91*b* can be in the lower cylindrical portion 22 with a lower keel frustoconical portion 23 extending from the lower cylindrical portion.

In embodiments, the first displacement reduction device can eliminate an amount of friction from the outer water column and the entrapped displacement in the moon pool area. In embodiments, only one displacement reduction device can be used.

The lower cylindrical portion 22 can have a second displacement reduction device 91*b* opposite the first displacement reduction device 91. The displacement reduction devices can be identical in size and shape or can vary in size and shape. The displacement reduction devices can be installed in groups around the outer hull side, such as groups of three or four.

The displacement reduction devices can be cut outs in the hull to change the displacement, like a window in the hull without glass. The size of the displacement reduction devices can have a length from 10 feet to 20 feet and a height from 10 feet to 20 feet.

Figure 7:
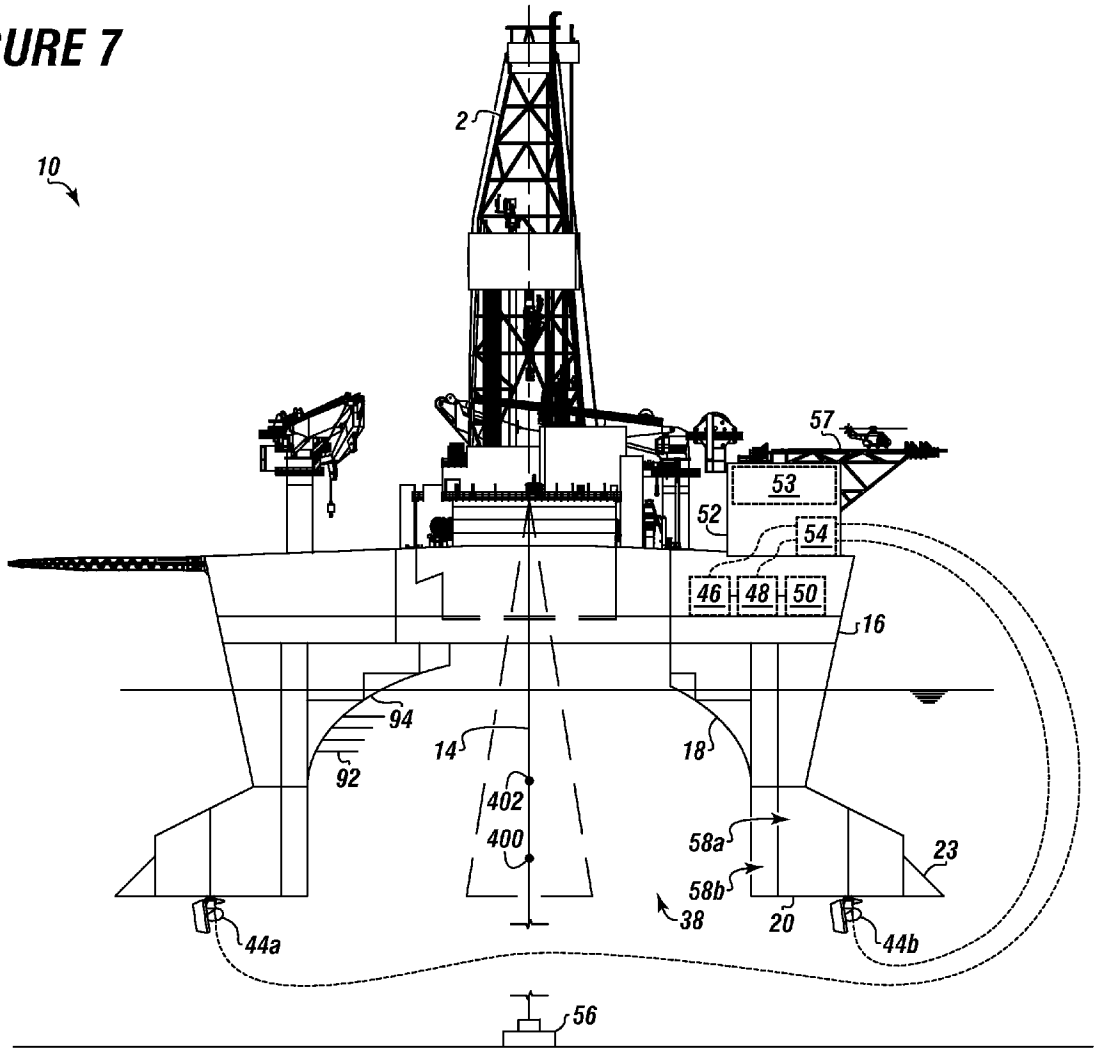
FIG. 7 depicts a buoyant structure with a derrick.

FIG. 7 depicts a buoyant structure with a derrick.

The buoyant structure 10 can have a derrick 2 mounted on the main deck. In embodiments, the derrick can be incorporated into the hull.

The buoyant structure can have a lower center of gravity 400 than the center of buoyancy 402. The center of gravity and center of buoyancy can occur in the moon pool 38.

The buoyant structure 10 can include the outer hull side 16, inner hull side 18, planar keel 20, propellers 44*a* and 44*b*, helipad 57, ballast tanks 58*a* and 58*b*, heave control terraces 92, wall portion 94 of the moon pool, vertical axis 14, lower keel frustoconical portion 23, and control center 52 with navigation system 54.

The navigation system 54 can be in communication with the motor 46 and the generator 48. The navigation system 54 for dynamic positioning can be a unit from Raytheon.

Up to eight propellers or thrusters can be used for good dynamic positioning. The fuel tank 50 can be connected to the generator. In embodiments, the fuel tank can engage both the motor and generator simultaneously.

A pilot house can include the control center, which can additionally have controls for not only the motor, but also controls for safety equipment, controls for the ballast system, communications such as to the Internet and satellite systems, and aviation communication.

The buoyant structure, in embodiments, can include accommodations 53 for crew which can include galleys, staterooms, salons, office space, hospital, radio, machine shops and test labs.

The well 56 to be drilled by the buoyant structure can be an oil well or a natural gas well.

In embodiments, from 10 ballast tanks to 40 ballast tanks can be used in the buoyant structure, each of which can also be controlled from the control center 52.

In embodiments, buoyant structure can include sanitation systems, fire control equipment, and emergency evacuation equipment, such as lifeboats.

The buoyant structure can also accommodate a flare, a crane, a bulk connection station, blowout protection and marine riser systems, and a remotely operated vehicle station.

In embodiments, the derrick can be a single hoist or dual hoist derrick with associated top drives and heave compensators along with tubular make up and break out equipment.

In embodiments, the hull can accommodate 30,000 metric tons of variable deck load to accommodate a drilling operation of a well that has a 40,000 foot well depth and is in 12,000 feet of water.

Figure 8:
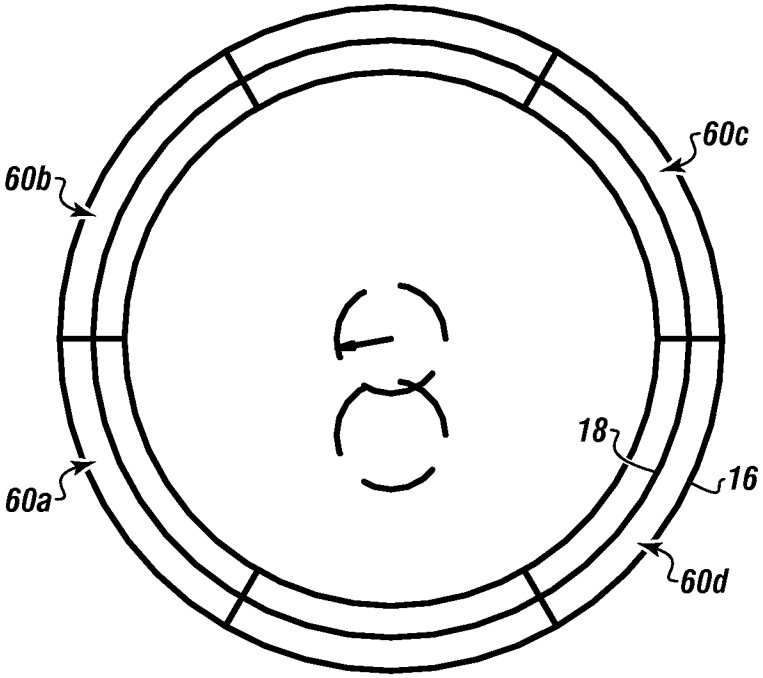
FIG. 8 depicts a top view of the watertight compartments between the inner hull side and outer hull side of the buoyant structure.

FIG. 8 depicts a top view of the watertight compartments 60*a*-60*d* between the inner hull side 18 and outer hull side 16 of the buoyant structure.

In an embodiment the total height of the hull from keel to main deck can be 52 meters. The height to the top of the drill floor can be 60 meters. The height to the top of the helipad can be 64 meters. The height to the top of the derrick can be 130 meters.

Figure 9:
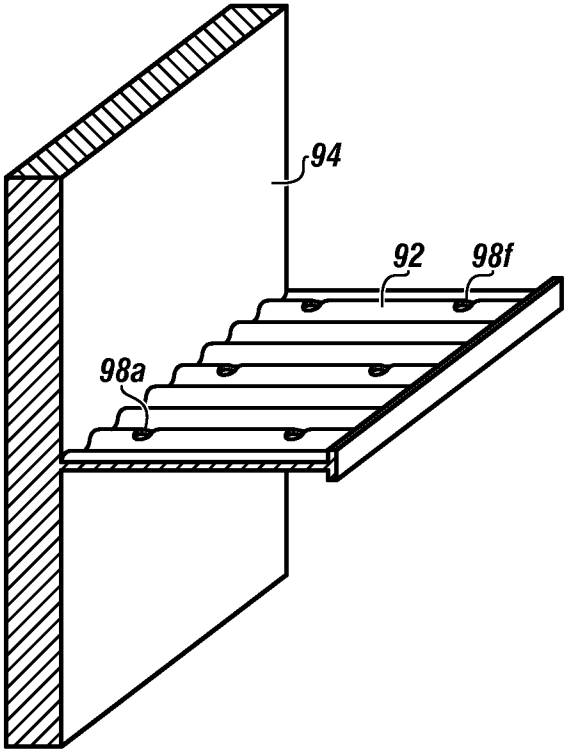
FIG. 9 depicts a detailed view of one of the heave control terraces mounted to the wall portion.

FIG. 9 depicts a detailed view of one of the heave control terraces 92 mounted to the wall portion 94. The heave control terraces can have a plurality of perforations 98*a*-98*f*.

The perforations can range in diameter from 50 centimeters to 60 centimeters. The perforations can be randomly positioned on the heave control terraces. The perforations can be used to allow flow through of water and reduce a maximum buildup of water pressure in the moon pool.

Figure 10:
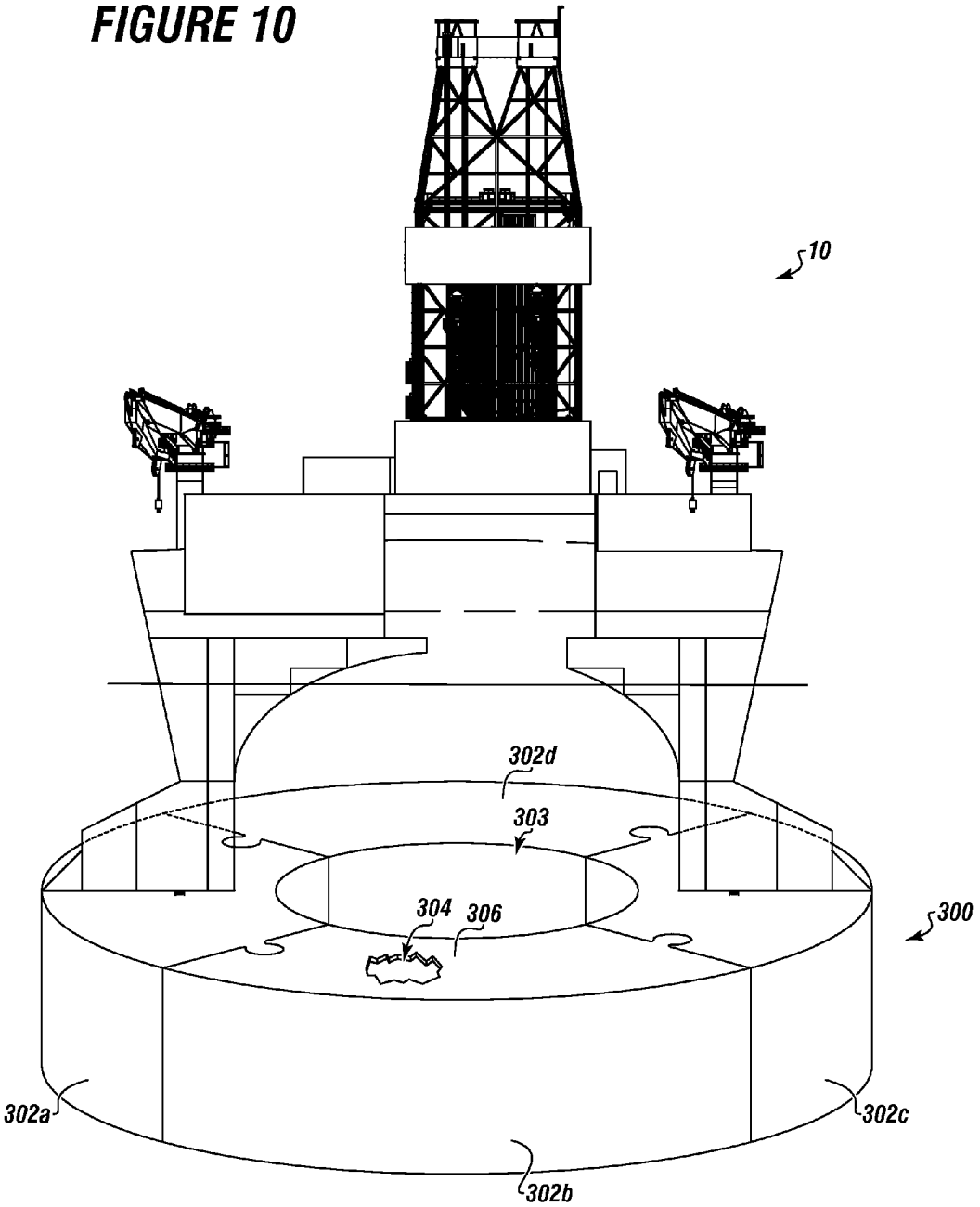
FIG. 10 depicts an embodiment of the buoyant structure supported over a chambered buoyant storage ring.

FIG. 10 depicts an embodiment of the buoyant structure 10 supported over a chambered buoyant storage ring 300 formed from a plurality of bulkheaded storage sections 302*a*-302*d*.

In an embodiment, the chambered buoyant storage ring 300 is positionable and lockable beneath the buoyant structure allowing drilling using the buoyant structure simultaneously with the chambered buoyant storage ring through the moon pool of the buoyant structure and through a central opening 303 in the chambered storage ring establishing an environmentally safe contained environment for operations.

The chambered buoyant storage ring 300 can have a plurality of bulkheaded storage sections 302*a*-302*d* each having a roof 306 over a chamber 304 for storing at least one of: fluids, solids, and gasses, such as hydrocarbons including oil. The bulkheaded storage sections can be interconnected and double walled.

Figure 11:
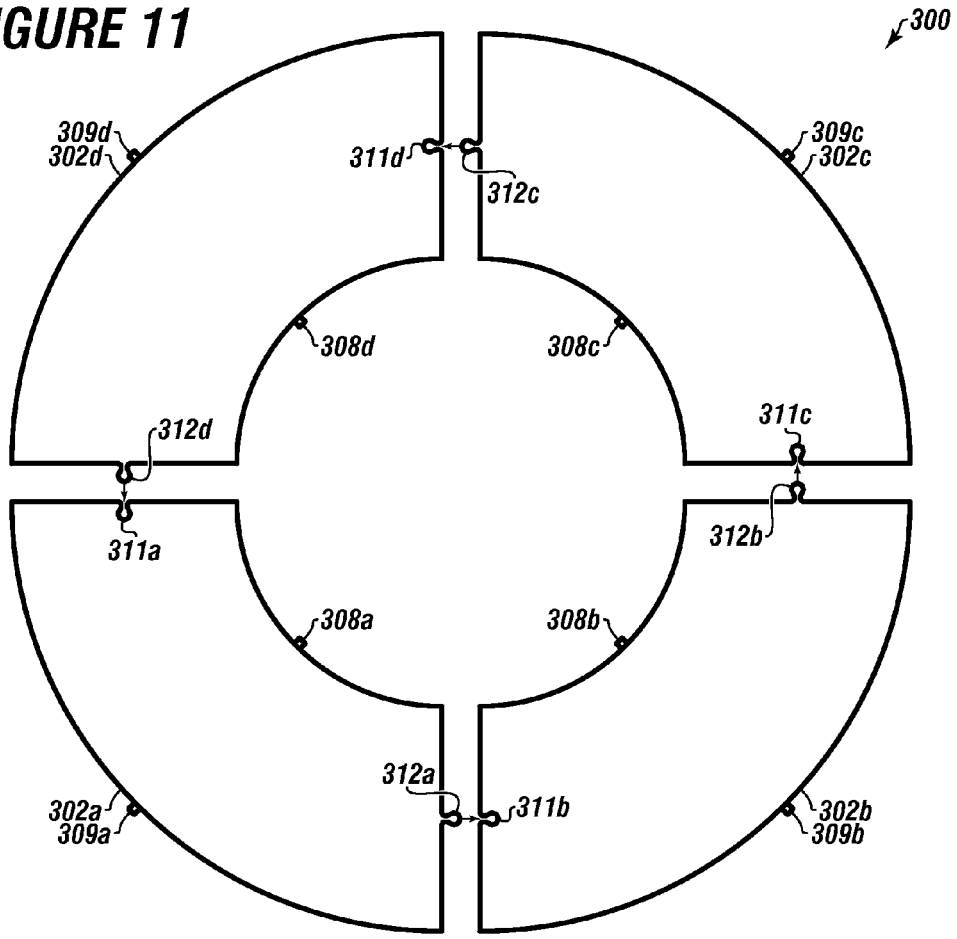
FIG. 11 depicts a top view of the chambered buoyant storage ring.

FIG. 11 depicts a top view of the chambered buoyant storage ring.

The chambered buoyant storage ring 300 can provide a semi-permanent subsea landing platform for the buoyant structure.

In embodiments, the chambered buoyant storage ring can provide a flush engagement with the planar keel or an engagement using outer stabs and inner stabs, enabling at least one of: a subsea operation and a reservoir operation through the moon pool and the central opening simultaneously.

When the chambered buoyant storage ring and the buoyant structure are connected, an environmentally safe condition for subsea or reservoir operations can be created.

Each bulkheaded storage section 302*a*-302*d* can have an inlet port 308*a*-308*d* and outlet port 309*a*-309*d* for flowing at least one of: fluids, solids and gases into or out of the chamber.

Each bulkheaded storage section 302*a*-302*d* can have a receptacle 311*a*-311*d* on one side and an interlocking finger 312*a*-312*d* on the other side for engaging the receptacle of an adjacent bulkheaded storage section, allowing the bulkheaded storage sections to interlock together.

Figure 12A:
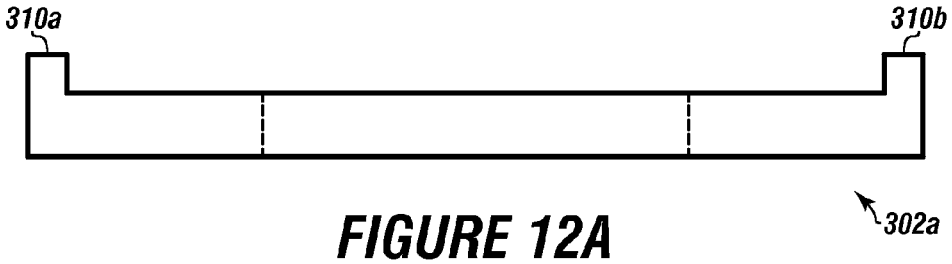
FIG. 12A depicts an embodiment of a bulkheaded storage section with two outer stabs.

FIG. 12A depicts an embodiment of a bulkheaded storage section 302*a* with two outer stabs 310*a* and 310*b*. The outer stabs can rise in parallel on one side, to an outer perimeter of the bulkheaded storage sections.

Figure 12B:
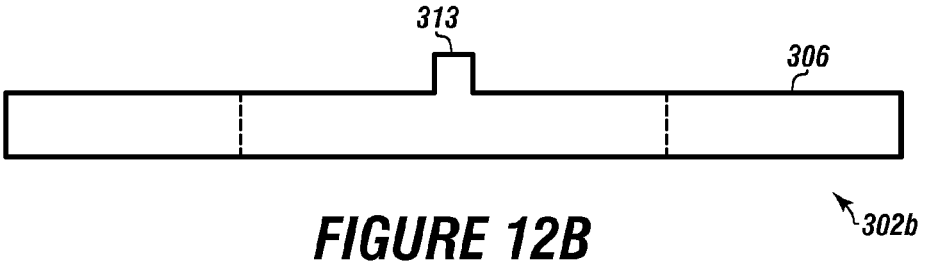
FIG. 12B depicts an embodiment of a bulkheaded storage section with an inner stab.

FIG. 12B depicts an embodiment of a bulkheaded storage section 302*b* with an inner stab 313.

Figure 12C:
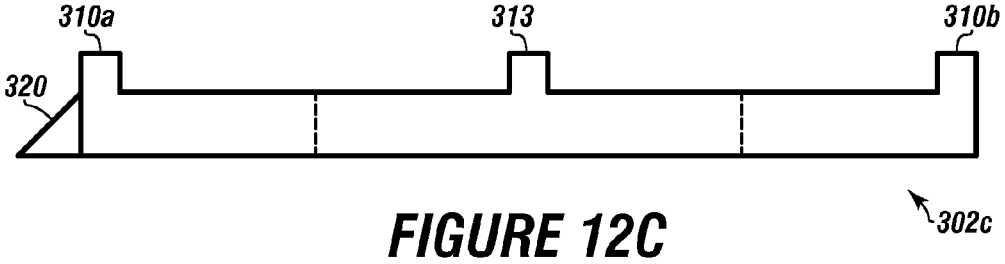
FIG. 12C depicts an embodiment of a bulkheaded storage section with two outer stabs and one inner stab.

FIG. 12C depicts an embodiment of a bulkheaded storage section 302*c* with two outer stabs 310*a* and 310*b* and one inner stab 313.

The chambered buoyant storage ring storage ring 302*c* can further have a continuous scouring prevention stabilizer 320. In embodiments, a continuous prevention scouring stabilizer can be connected to each interlocking segment of the chambered buoyant storage ring on an outer wall.

The continuous scouring prevention stabilizer can extend in a direction away from the vertical axis when the buoyant structure is mounted to the chambered buoyant storage ring. The continuous scouring prevention stabilizer, in embodiments, can extend from 40 percent to 95 percent the vertical height of one of the bulkheaded storage sections. The continuous scouring prevention stabilizer, in embodiments, can extend from the outer wall of the bulkheaded storage section at an angle from 30 degrees to 70 degrees from the outer wall.

The outer stabs can be formed from steel and rise from 1 foot to 15 feet from the roof. Each outer stab can have a width across the roof from 1 foot to 15 feet. In embodiments, the outer stabs can be square or rectangular. The inner stabs can be identical to the outer stabs.

The following describes the sequence of steps usable in the method that utilizes the buoyant structure.

The buoyant structure can be used in three phases, phase 1: load out, phase 2: transit and phase 3: operations.

The following describes the sequence of steps for phase 1: load out.

The method can include conditioning the buoyant structure's hull, drilling equipment and ballast tanks with seawater to provide a minimum draft, from 4 meters to 15 meters in this embodiment, to accommodate mobilization of the marine equipment and drilling equipment in preparation for offshore drilling areas.

This allows the buoyant structure to be made ready in shallow water ports that are not usable by semisubmersibles or drill ships that require greater drafts. In this step, the bell shaped moon pool contains the least amount of water enabling physical inspection of the hull, and rigging up equipment prior to use offshore.

The method can include loading the drilling equipment necessary for a full campaign onto the buoyant structure while the buoyant structure is deballasted and in port. The drilling equipment can include drilling pipes, marine risers, casings, and single/dual blowout preventers.

The following describes the sequence of steps for phase 2: transit.

The method can include identifying a drilling location for destination, starting the thrusters, and leaving port in a deballasted/transit condition.

The method can include arriving at the identified drilling location and engaging the dynamic positioning system to maintain the buoyant structure over the subsea drilling location.

The method can include ballasting the buoyant structure to operational draft at the drilling location while the dynamic positioning system is operating, ensuring that the lower cylindrical portion, the lower frustoconical portion and a portion of the upper frustoconical portion are underwater and the ballast tanks are full or at least partially filled to lower the center of gravity and contribute to maintaining a positive stability curve for the buoyant structure at all times.

If tunnels are used in an embodiment, the tunnels will significantly reduce water drag while the buoyant structure is in transit or while the buoyant structure is in operation and allow positive water flow through the horizontal water collar, effectively reducing the hydrodynamic resistance (drag force) and negative effect on displacement caused by water trapped inside the hull.

Once on drilling location, the structure will initiate the distribution of seawater ballast within the structure, thereby allowing the structure to adjust from transit draft to operational draft.

The ballasted unit will lower the center of gravity and contribute to a maintaining at all times a positive stability curve.

The power distribution and control of the thruster, coupled with state of the art computerized dynamic station-keeping of the structure and the drilling equipment located in and on top of the moon pool and on the deck will be centered over the selected subsea drilling location.

The performance of the drilling equipment and highest safety of operability attributes are the allowable offset tolerances of the buoyant structure, its moon pool and the influence of the environment in any operational theater.

The buoyant structure operating envelope is dictated by wind speed, current, hydrodynamic environment, coupled with thruster utilization and dynamic allowances. Those results are coupled with operational displacement parameters of the structure underwater hull.

The following describes the sequence of steps for phase 3: operations. Operations include the operation of the ballasted buoyant structure while at a subsea drilling location.

The method can include coupling computerized dynamic station keeping of the buoyant structure with power management and initiating operation of drilling equipment located in and on top of the moon pool and on the deck while the buoyant structure is centered over the subsea drilling location using an onboard processor and data storage in the control center, wherein the onboard data storage has computer instructions to manage the structure operating envelope including using sensed wind speed, sensed current, and actual dynamic positioning thruster utilization compared to preset operational displacement parameters of the buoyant structure while operating drilling equipment.

The following steps can be performed while the buoyant structure is in the operational condition. In the operational condition, the buoyant structure has been ballasted and also displacement reduction devices engaged.

The method can include placing the displacement reduction devices sufficiently below the surface water, allowing the trapped water within the moon pool to communicate with the external hydrodynamic environment for enhanced stability while operating drilling equipment.

The method can include using tunnels to improve the overall displacement of moon pool water thus increasing the stability and operational envelope of the buoyant structure.

The method can include attaching the heave control terraces to the walls of the moon pool to break up the water column inside the moon pool. This operation will reduce the buoyant structure's heave and also allow access to walkways and safety steps within the circumference of the moon pool.

While these embodiments have been described with emphasis on the embodiments, it should be understood that within the scope of the appended claims, the embodiments might be practiced other than as specifically described herein.

What is claimed is:

1. A buoyant structure for at least one of: petroleum drilling, production, storage, and offloading, wherein the buoyant structure comprises:

a. a hull defining a vertical axis, whereby the hull has an outer hull side connected to an inner hull side, and the outer hull side is characterized by an outer hull side shape selected from the group: circular, elliptoid, and geodesic in horizontal cross-sections at all elevations; and the hull has an upper hull diameter and the inner hull side characterized by a shape selected from the group: circular, elliptoid, and geodesic;

b. a planar keel defining a lower hull diameter;

c. a lower cylindrical portion connected to the planar keel, wherein an lower cylindrical portion diameter is identical to the lower hull diameter, and the lower hull diameter is the largest diameter of the hull, and further wherein the lower cylindrical portion diameter is from 105 percent to 130 percent of the upper hull diameter;

d. a lower frustoconical portion disposed above the lower cylindrical portion formed with an inwardly sloping wall at a first angle ranging from 50 degrees to 70 degrees with respect to the vertical axis;

e. an upper frustoconical portion directly connected to the lower frustoconical portion, the upper frustoconical portion with an outwardly sloping wall sloping at a second angle with respect to the vertical axis from 3 degrees to 45 degrees, and wherein the lower frustoconical portion with the inwardly sloping wall, abuts the outwardly sloping wall forming a hull neck with a hull neck diameter;

f. a main deck connected over the upper frustoconical portion;

g. a moon pool formed by the inner hull side characterized by a shape selected from the group: circular, elliptoid, and geodesic having a first moon pool diameter proximate the main deck which increases to a second moon pool diameter proximate the planar keel wherein the second moon pool diameter is less than the upper hull diameter; and h. at least one ballast tank in communication with a control center in the hull, the at least one ballast tank is for ballasting and deballasting the hull; and wherein the buoyant structure defines a center of gravity below a center of buoyancy in the moon pool.

2. The buoyant structure of claim 1, further comprising propellers attached to the planar keel operated by a motor, connected to a generator, with the motor and the generator connected to a fuel tank, with the propellers, the motor, and the generator communicating with a navigation system in a control center mounted above the main deck with the control center using the navigation system to dynamically position the ballasted buoyant structure over a well for drilling or for propulsion during transit when deballasted.

3. The buoyant structure of claim 1, comprising a plurality of watertight compartments between the outer hull side and the inner hull side.

4. The buoyant structure of claim 1, comprising an upper cylindrical portion connected between the main deck and the upper frustoconical portion.

5. The buoyant structure of claim 1, comprising a first tunnel extending through the lower cylindrical portion to the moon pool, wherein the first tunnel has a first tunnel first side wall, a first tunnel second side wall and a first tunnel top connecting the first tunnel side walls.

6. The buoyant structure of claim 5, comprising a first tunnel bottom connected between the first tunnel side walls.

7. The buoyant structure of claim 5, comprising a second tunnel extending through the lower cylindrical portion into the moon pool, the second tunnel comprising a pair of second tunnel side walls connected with a second tunnel top.

8. The buoyant structure of claim 7, comprising a second tunnel bottom in the second tunnel connected between the second tunnel side walls.

9. The buoyant structure of claim 1, wherein the moon pool is centrally formed around the vertical axis.

10. The buoyant structure of claim 1, wherein an elliptoid moon pool has a minor radius which is 10 percent to 30 percent the diameter of the main deck and a major radius which is 25 percent to 50 percent the diameter of the main deck.

11. The buoyant structure of claim 1, comprising a constant diameter portion for the moon pool that extends up to 16 meters from the planar keel and is formed in the lower cylindrical portion extending to the planar keel.

12. The buoyant structure of claim 1, comprising a plurality of heave control terraces formed in a wall portion of the moon pool.

13. The buoyant structure of claim 1, comprising a lower keel frustoconical portion extending from the lower cylindrical portion in a direction away from the vertical axis.

14. The buoyant structure of claim 12, comprising a plurality of perforations in each of the plurality of heave control terraces.

15. The buoyant structure of claim 1, comprising a first displacement reduction device formed in the upper frustoconical portion or the lower frustoconical portion.

16. The buoyant structure of claim 15, comprising a second displacement reduction device formed in the upper frustoconical portion or lower frustoconical portion opposite the first displacement reduction device.

17. The buoyant structure of claim 1, comprising a plurality of lower decks formed in the hull between the main deck and the lower frustoconical portion.

18. The buoyant structure of claim 1, comprising: a chambered buoyant storage ring with an opening mounted to the hull of the buoyant structure, the chambered buoyant storage ring providing a semi-permanent subsea landing platform for a buoyant vessel, wherein the chambered buoyant storage ring provides an engagement with the planar keel enabling at least one of: a subsea operation and a reservoir operation through the moon pool and the opening, simultaneously, creating an environmentally safe condition for the subsea operation, the reservoir operation, or both the subsea operation and the reservoir operation.

19. The buoyant structure of claim 18, wherein the chambered buoyant storage ring comprises a plurality of bulkheaded storage sections, wherein each bulkheaded storage section comprises:

a. a chamber for storing fluids, solids, gases, or combinations thereof;
b. a roof over the chamber;
c. an inlet port and an outlet port for flowing fluids, solids, gases, or combinations thereof into or out of the chamber;
d. a receptacle on each bulkheaded storage section; and
e. an interlocking finger on each bulkheaded storage section for engaging a receptacle on an adjacent bulkheaded storage section allowing bulkheaded storage sections to interlock together.

20. The buoyant structure of claim 19, wherein each bulkheaded storage section comprises an outer stab, an inner stab, or both the outer stab and the inner stab.

21. The buoyant structure of claim 18, wherein the chambered buoyant storage ring has a capacity from 4597 cubic meters to 305614 cubic meters.

22. The buoyant structure of claim 18, wherein the chambered buoyant storage ring comprises from three to four bulkheaded storage sections interlocking as jigsaw puzzle pieces.

23. The buoyant structure of claim 19, wherein each bulkheaded storage section is ballasted to float underwater.

24. The buoyant structure of claim 5, comprising a hydro transit diverter bulkhead formed between at least one of the first tunnel side walls of the first tunnel extending into the moon pool attached to the planar keel.

25. The buoyant structure of claim 18, comprising a continuous scouring prevention stabilizer connected around the chambered buoyant storage ring.

26. The buoyant structure of claim 1, comprising a derrick, a helipad, accommodations, or combinations thereof.

27. The buoyant structure of claim 24, comprising at least one ballast tank compartment formed in the hydro transit diverter bulkhead.

* * * * *